US008671523B1

(12) United States Patent
Day

(10) Patent No.: US 8,671,523 B1
(45) Date of Patent: Mar. 18, 2014

(54) CARRIER REMOVABLY ATTACHABLE TO AN OBJECT FOR MORE EASILY AND ERGONOMICALLY CARRYING THE OBJECT

(71) Applicant: Nathaniel R. Day, Gilbert, AZ (US)

(72) Inventor: Nathaniel R. Day, Gilbert, AZ (US)

( * ) Notice: Subject to any disclaimer, the term of this patent is extended or adjusted under 35 U.S.C. 154(b) by 0 days.

(21) Appl. No.: 13/917,248

(22) Filed: Jun. 13, 2013

Related U.S. Application Data

(60) Provisional application No. 61/781,645, filed on Mar. 14, 2013.

(51) Int. Cl.
*B25G 3/20* (2006.01)

(52) U.S. Cl.
USPC ..... 16/426; 16/422

(58) Field of Classification Search
USPC ..... 16/426, 110.1, 406, 408, 411, 421, 422, 16/425, 430, 444, 445, 446, 900, DIG. 24, 16/DIG. 25; 224/158, 159; 294/137, 165, 294/167, 169; 297/183.1, 183.2, 18.3, 297/183.4, 463.1; D6/333; D9/434
See application file for complete search history.

(56) References Cited

U.S. PATENT DOCUMENTS

| | | | | |
|---|---|---|---|---|
| 4,059,209 | A | 11/1977 | Grisel | |
| 4,466,523 | A * | 8/1984 | De Carolis et al. | 81/62 |
| 4,523,781 | A | 6/1985 | Brody | |
| 5,207,476 | A | 5/1993 | Payne | |
| D374,622 | S | 10/1996 | Winborne | |
| 5,651,581 | A | 7/1997 | Myers et al. | |
| 5,806,924 | A | 9/1998 | Gonas | |
| 5,870,800 | A * | 2/1999 | Chao | 16/422 |
| 5,887,950 | A | 3/1999 | Kuo | |
| 6,182,536 | B1 * | 2/2001 | Roberts et al. | 81/63 |
| D451,312 | S | 12/2001 | Kain | |
| 6,688,259 | B2 | 2/2004 | Axel | |
| 7,014,232 | B2 | 3/2006 | Bosa | |
| 7,657,972 | B2 | 2/2010 | Jenkins | |
| D619,367 | S | 7/2010 | Zhang | |
| D629,301 | S | 12/2010 | Jarrell et al. | |
| 8,123,269 | B2 | 2/2012 | Zhang | |
| 2005/0085352 | A1 | 4/2005 | Baxter | |
| 2006/0087139 | A1 | 4/2006 | Ayres | |
| 2007/0060405 | A1 | 3/2007 | Grossman et al. | |
| 2007/0209162 | A1 * | 9/2007 | McRoberts et al. | 16/426 |
| 2008/0217368 | A1 | 9/2008 | Denton | |
| 2011/0173778 | A1 | 7/2011 | Wales | |
| 2013/0009414 | A1 | 1/2013 | LeClaire et al. | |
| 2013/0045099 | A1 | 2/2013 | Bicknell | |

* cited by examiner

OTHER PUBLICATIONS

Clamann et al, "Comparison of infant car seat grip orientations and lift strategies," Applied Ergonomics, pp. 1-8 (2011).

*Primary Examiner* — Jeffrey O Brien
(74) *Attorney, Agent, or Firm* — Panitch Schwarze Belisario & Nadel LLP

(57) ABSTRACT

A carrier removably attachable to at least a portion of a handle of an object includes a first housing having a handle and a base. The handle of the first housing is rotatable with respect to the base of the first housing about a first axis. A second housing is pivotally attached to the base of the first housing about a second axis. The second axis extends generally perpendicularly to the first axis. The carrier is pivotable between an open configuration in which at least a portion of the base of the first housing is at least partially separated from the second housing to receive at least a portion of a handle of an object therein and a closed configuration in which at least a portion of the base of the first housing and the second housing combine to surround the handle of the object therebetween.

9 Claims, 4 Drawing Sheets

CARRIER REMOVABLY ATTACHABLE TO AN OBJECT FOR MORE EASILY AND ERGONOMICALLY CARRYING THE OBJECT

CROSS-REFERENCE TO RELATED APPLICATIONS

The present application claims priority to U.S. Provisional Application No. 61/781,645, filed on Mar. 14, 2013 and entitled "Carrier Removably Attachable To An Object For More Easily And Ergonomically Carrying The Object," which is hereby incorporated by reference.

BACKGROUND OF THE INVENTION

The present invention relates generally to a carrier removably attachable to an object and, more particularly, to a carrier removably attachable to a portion of a handle of a children's car seat or other seat or carrier.

Conventional car or other seats or carriers are well known for safely and conveniently transporting a relatively young or small child, such as a baby or infant. Referring to FIGS. 5 and 6, as a child 11 grows, it can be awkward and/or difficult for an adult or other individual 13 to lift or move such a car seat 10 or other seat or carrier by a handle 12 thereof.

For example, the orientation of the handle 12 often requires that the palm 13*a* (see FIG. 6) of the individual 13 carrying the seat 10 must be in a frontward position (toward the direction of movement) or rearward position (opposite the direction of movement). However, it is not always ergonomically natural for many individuals to carry a relatively heavy weight at their side with their palm 13*a* in either of these positions. Instead, it is often more natural for an individual's palm 13*a* to be positioned inwardly (i.e., approximately ninety degrees from the direction of movement). Given the length of a typical car seat 10, it can be difficult to carry the car seat 10 with the individual's palm 13 positioned inwardly because doing so often results in the car seat 10 hitting the individual 13 (such as in the leg).

It has yet to be discovered how to more easily, ergonomically and comfortably carry a children's car seat or other seat or object. In particular, it has yet to be discovered how to create an attachment removably mountable to a handle of a children's seat or another carrier object, wherein at least a portion of the attachment conveniently rotates with respect to the handle to allow an individual to more easily, naturally and/or comfortably carry the seat or the object. The present invention accomplishes the above and other objectives.

BRIEF SUMMARY OF THE INVENTION

Briefly stated, one aspect of the present invention is directed to a carrier removably attachable to at least a portion of a handle of an object. The carrier includes a first housing having a handle and a base. The handle of the first housing is rotatable with respect to the base of the first housing about a first axis. A second housing is pivotally attached to the base of the first housing about a second axis. The second axis extends generally perpendicularly to the first axis. The carrier is pivotable between an open configuration in which at least a portion of the base of the first housing is at least partially separated from the second housing to receive at least a portion of a handle of an object therebetween and a closed configuration in which at least a portion of the base of the first housing and the second housing combine to surround the handle of the object therebetween.

In another aspect, the present invention is directed to a combination including an object and a carrier. The object includes a handle and the carrier is removably attachable to at least a portion of the handle of the object. The carrier includes a first housing having a handle and a base. The handle of the first housing is rotatable with respect to the base of the first housing about a first axis. A second housing is pivotally attached to the base of the first housing about a second axis. The second axis extends generally perpendicularly to the first axis. The carrier is pivotable between an open configuration in which at least a portion of the base of the first housing is at least partially separated from the second housing to receive at least a portion of the handle of the object therebetween and a closed configuration in which at least a portion of the base of the first housing and the second housing combine to surround of the handle of the object.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1:
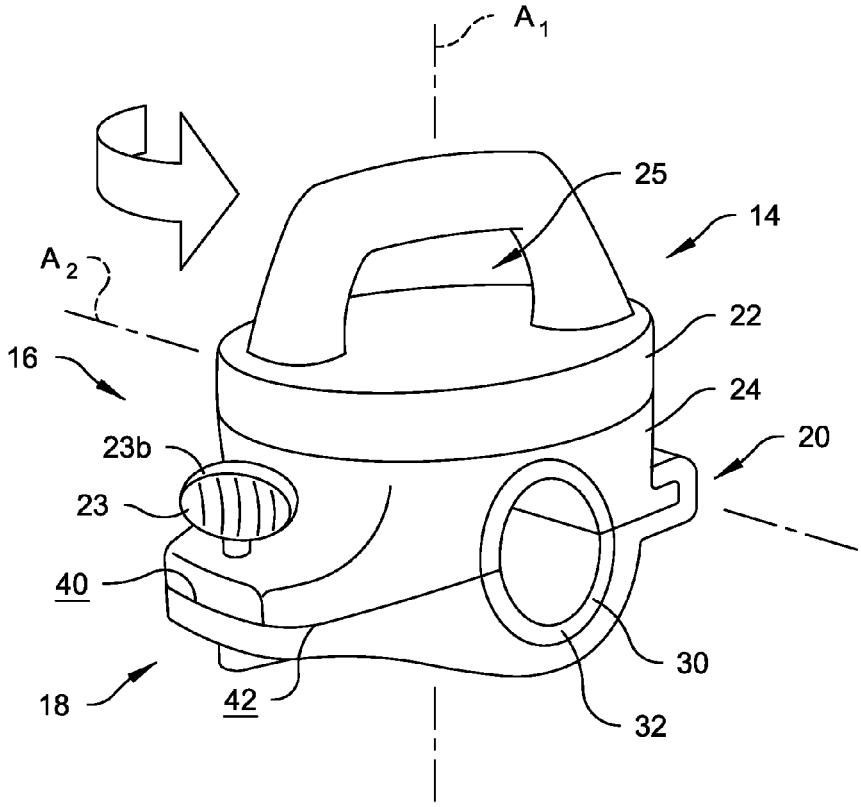
FIG. 1 is a top perspective view of a carrier in accordance with a preferred embodiment of the present invention, wherein the carrier is shown in a closed or use configuration.

Certain terminology is used in the following description for convenience only and is not limiting. The words "lower," "bottom," "upper," "top," "frontward" and "rearward" designate directions in the drawings to which reference is made. The words "upwardly," "inwardly" and "outwardly" refer to directions toward and away from, respectively, the geometric center of the device, and designated parts thereof, in accordance with the present invention. Unless specifically set forth herein, the terms "a," "an" and "the" are not limited to one element, but instead should be read as meaning "at least one." The terminology includes the words noted above, derivatives thereof and words of similar import.

Figure 3:
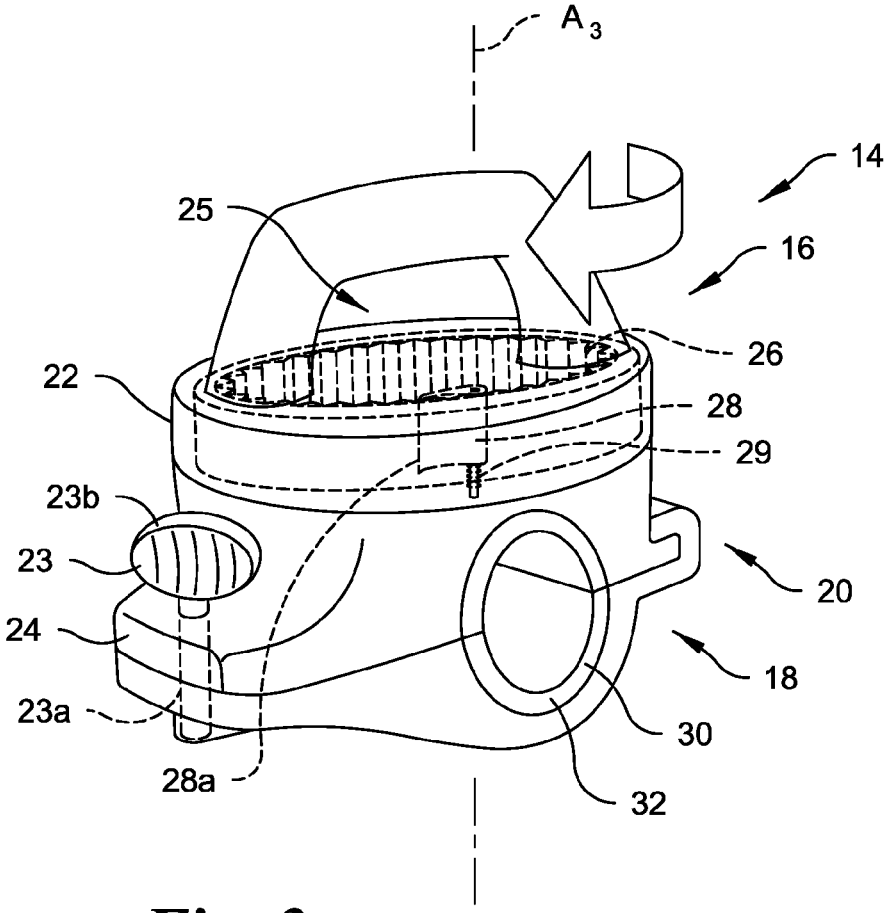
FIG. 3 is a top perspective view of the carrier of FIG. 1, wherein certain portions of the carrier are shown as being at least partially transparent for clarity.
Figure 4:
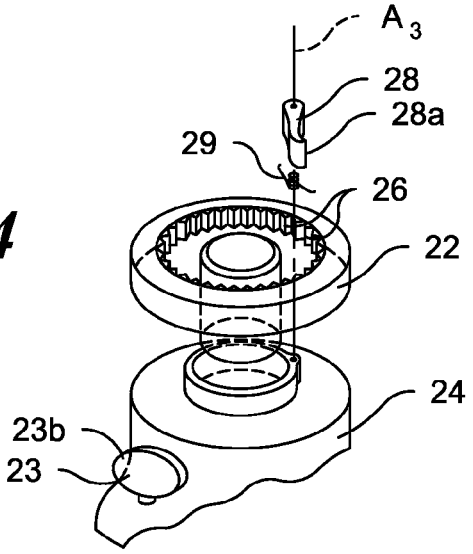
FIG. 4 is a perspective view of the carrier of FIG. 1, wherein certain portions of the carrier are omitted for clarity.
Figure 5:
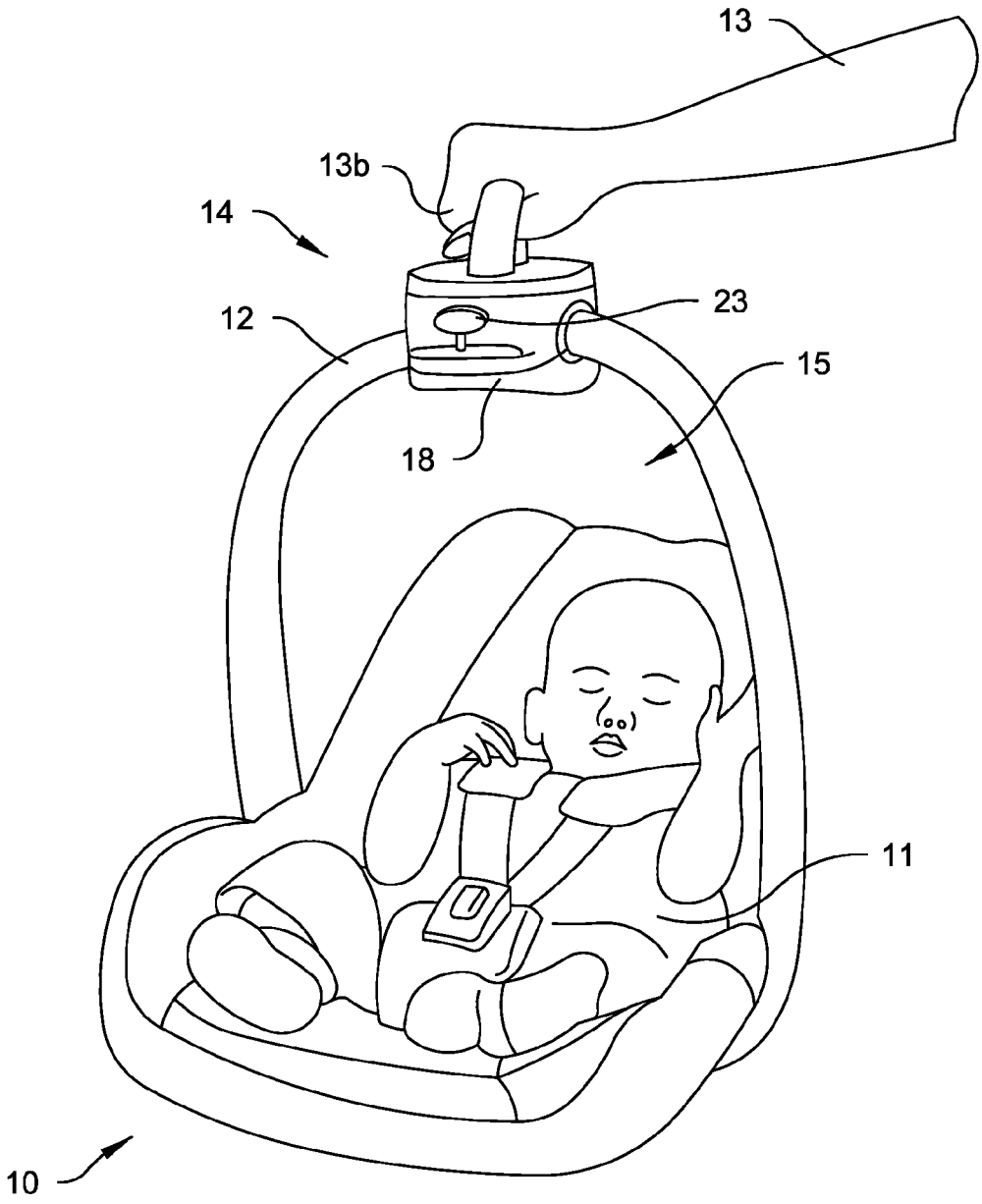
FIG. 5 is a perspective view of the carrier of FIG. 1 attached to a child seat to be carried, wherein the carrier is shown in an ergonomically comfortable configuration.
Figure 6:
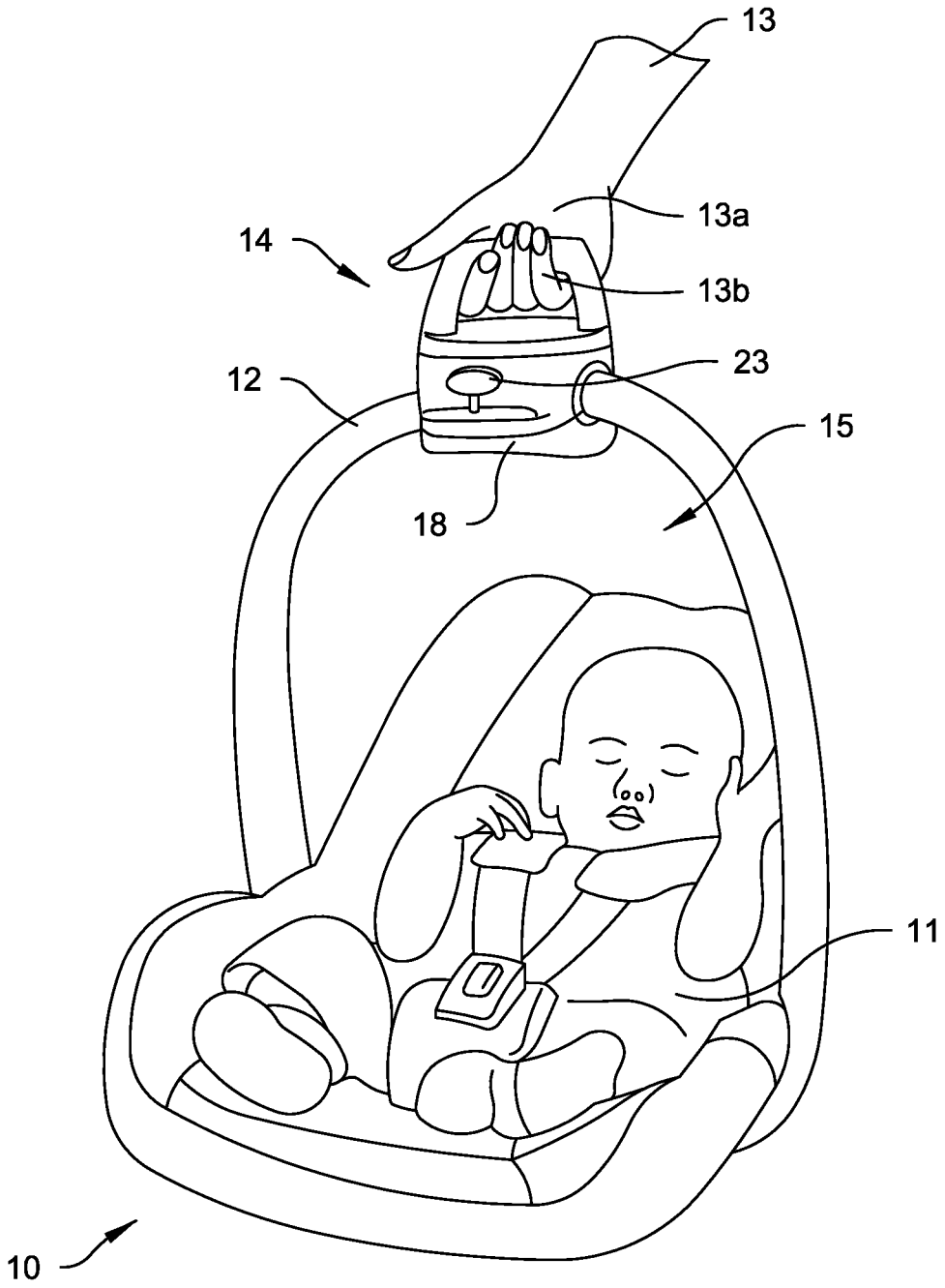
FIG. 6 is a perspective view of the carrier of FIG. 1 attached to a child seat to be carried, wherein the carrier is shown in a less ergonomically comfortable configuration.

Referring to the drawings in detail, wherein like numerals indicate like elements throughout the several views, FIGS. 1-4 illustrate an attachment or carrier, generally designated 14, and FIGS. 5-6 illustrate a combination including the carrier 14 and an object, such as a children's car or other seat, generally designated 10, in accordance with a preferred embodiment of the present invention. The carrier 14 is designed to allow a user or individual 13 (see FIGS. 5 and 6) to more easily, ergonomically and comfortably carry the car seat 10 or some other type of seat or object (not shown).

The carrier 14 is preferably conveniently separable from and removably attachable to at least a portion of the car seat 10, such as a handle 12 thereof, without the use of tools. The handle 12 may be at least partially arcuate and/or in the shape of a generally inverted U, and assists the user 13 in lifting or transporting the car seat 10, generally by one hand. The handle 12 preferably defines a passageway 15 with a remainder of the car seat 10, and the handle 12 is preferably pivotably attached to a reminder of the car seat 10. However, the combination is not limited to the inclusion of the car seat 10, as the carrier 14 may be removably attachable to almost any object, such as a basket, a shopping or grocery bag, luggage, one or more skis, a ladder, a shovel, a toolbox or the like, which is often carried or transported by an individual 13.

Referring to FIGS. 1-6, the carrier 14 preferably includes a first or upper housing 16 having a handle 22 and a base 24. The handle 22 of the first housing 16 preferably defines a slot or opening 25 that is sized, shaped and/or configured to receive at least a portion of the user's hand therein. The user's hand preferably grasps the carrier 14 with his/her palm 13*a* and fingers 13*b* (see FIG. 6) to lift the car seat 10. The handle 22 of the first housing 16 is preferably rotatable with respect to the base 24 of the first housing 16 about a first or vertical axis $A_1$ (see FIG. 1). The first axis $A_1$ preferably extends generally, if not exactly, vertically or perpendicularly to a ground or other support surface when the car seat 10 is being carried or is resting on the ground or other support surface. As described in more detail below, the handle 22 of the first housing 16 is preferably rotatable with respect to the base 24 of the first housing 16 over a span of at least or up to 360°.

The carrier 14 also preferably includes a second or lower housing 18 that is pivotably attached to at least a portion of the first housing 16. More particularly, the second housing 18 is preferably pivotably attached to the base 24 of the first housing 16 about a second or horizontal axis $A_2$ (see FIG. 1). The second axis $A_2$ preferably extends generally, if not exactly, perpendicularly to the first axis $A_1$, Thus, the second axis $A_2$ preferably extends generally, if not exactly, parallel to the ground or other support surface when the car seat 10 is being carried or is placed on the ground surface. The first and second housings 16, 18, and at least certain other components of the carrier 14, may be formed of a high strength, light weight material, such as a polymeric or metallic material or combination of materials.

Figure 2:
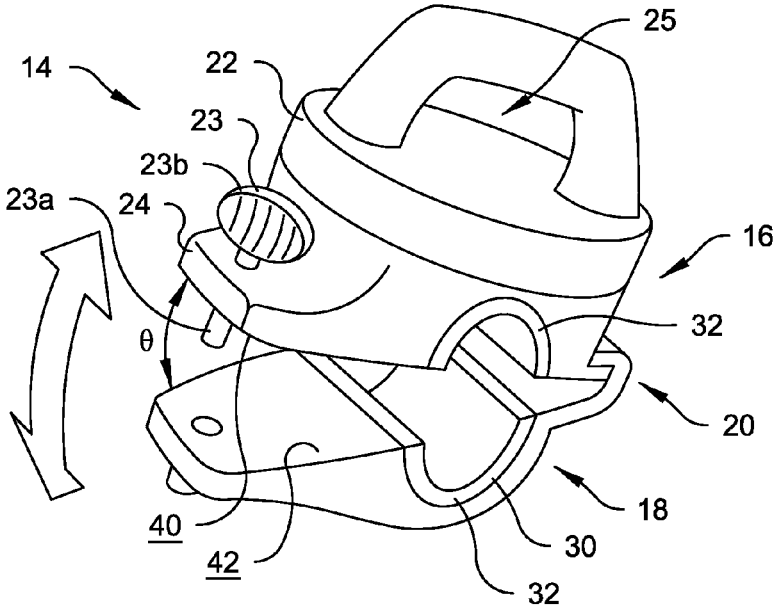
FIG. 2 is a top perspective view of the carrier of FIG. 1, wherein the carrier is shown in an open or installation configuration.

As shown in FIGS. 1-3, the carrier 14 may include a hinge 20 proximate one side or an outer periphery thereof. The hinge 20 preferably pivotally attaches the second housing 18 to the base 24 of the first housing 16. The hinge 20 may be formed simply as a portion of the base 24 of the housing 16 inserted into a portion of the second housing 18. However, the hinge 20 is not limited to the particular configuration shown and described herein. Instead, the hinge 20 may have any of a variety of forms, such as one or more barrel hinges, pivot hinges, living hinges and the like.

As shown in FIGS. 1 and 2, the carrier 14 is preferably positionable in and/or pivotable or movable between a first or open configuration (see FIG. 2) and a second or closed configuration (see FIG. 1). In the open configuration, at least a portion of the base 24 of the first housing 16 is preferably at least partially separated from or pivoted with respect to the second housing 18 to receive at least a portion of the handle 12 of the car seat 10 therebetween. The base 24 of the first housing 16 may only be pivotable with respect to the second housing 18 about the second axis $A_2$ by a relatively small angle θ, such as approximately 20-45°. The angle θ is preferably sufficiently large to allow the handle 12 of the car seat 10 to be positioned between the second housing 18 and the base 24 of the first housing 16. In the closed configuration, at least a portion of the base 24 of the first housing 16 and the second housing 18 completely surround at least a portion of the handle 12 of the car seat 10. In the closed configured, at least a portion of a planar bottom surface 40 of the base 24 of the first housing 16 contacts and/or extends parallel to at least a portion of a planar top surface 42 of the second housing 18.

Referring to FIGS. 1-6, a fastener 23, such as a thumbscrew, is preferably positioned on and/or attached to the base 24 of the first housing 16 or the second housing 18 (not shown) generally opposite the hinge 20. The fastener 23 permits the user 13 to selectively lock the base 24 of the first housing 16 to the second housing 18 in the closed configuration. The fastener 23 may be a threaded shaft 23*a* that extends through corresponding threaded holes in both the second housing 18 and the base 24 of the first housing 16. The fastener 23 may have an enlarged head or handle 23*b* that extends upwardly beyond a portion of the base 24 of the first housing 16 when the fastener 23 is attached to the base 24 of the first housing 16. The enlarged head 23*b* preferably allows the user 13 to more easily and quickly rotate the fastener 23 to thereby attach and/or remove the fastener 23 from the second housing 18 and the base 24 of the first housing 16.

However, the fastener 23 is not limited to the size, shape and/or configuration shown and described herein. For example, the fastener 23 may be a C-shaped or other clamp (not shown) that extends around at least a portion of the second housing 18 and the base 24 of the first housing 16 to generally lock the carrier 14 in the closed configuration. Alternatively, the fastener 23 may not be completely removable from both the second housing 18 and the base 24 of the first housing 16, which would reduce the possibility that the fastener 23 is inadvertently misplaced by the user 13 when not in use. For example, the fastener 23 may be a clip (not shown) that is pivotably and/or slidably attached to one of the second housing 18 and the base 24 of the first housing 16, and is removably attached to the other of the second housing 18 and the base 24 of the first housing 16 to generally lock the carrier 14 in the closed configuration.

As shown in FIGS. 1-3, 5 and 6, a passageway 30 preferably extends completely through the carrier 14 and is defined by at least a portion of the second housing 18 and the base 24 of the first housing 16. Each of the second housing 18 and the base 24 of the first housing 16 preferably has an arcuate or semi-circular portion that when combined form the passageway 30 when the carrier 14 is in the closed configuration. When the carrier 14 is in the closed configuration, the passageway 30 is preferably configured to receive and surround at least a portion of the handle 12 of the car seat 10 therein. The passageway 30 preferably has a generally cylindrical shape and extends generally, if not exactly, parallel to the second axis $A_2$. The passageway 30 preferably at least generally tightly engages the handle 12 of the car seat 10 with at least a friction fit.

Referring to FIGS. 1-3, resilient foam 32 or another elastic and/or resilient material is preferably located within a portion of the passageway 30. The foam 32 preferably contacts and provides a gripping force for at least a portion of the handle 12 of the car seat 10 when the carrier 14 is attached to the car seat 10. The foam 32 generally reduces the cross-sectional area of the passageway 30. However, the resilient or flexible nature of the foam 32 preferably adapts or conforms to a portion of the handle 12 of the car seat 10 when the carrier 14 is mounted to the handle 12 in the closed configuration. Thus, the foam 32 also allows the carrier 14 to accommodate handles 12 of various diameter or thickness. As a result, the carrier 14 can be considered "universal," such that the carrier 14 can adapt to handles of car seats or other objects of various sizes and shapes.

Referring to FIGS. 3 and 4, the carrier 14 may include a latch 28 that is pivotably attached to the base 24 of the first housing 16. The latch 28 is preferably pivotable with respect to the base 24 of the first housing 16 about a third axis $A_3$ (see FIGS. 3 and 4) that extends generally, if not exactly, parallel to the first axis $A_1$. The first axis $A_1$ is preferably laterally and/or radially spaced-apart from the third axis $A_3$. At least a portion of the latch 28 is preferably positioned within the handle 22 of the first housing 16. A biasing member 29, such as a coil spring, preferably engages at least a portion of the latch 28 and a portion of an interior of the handle 22 of the first housing 16. The biasing member 29 preferably biases at least a free end 28*a* of the latch 28 radially outwardly with respect to a geometric center of the carrier 14.

An interior portion of the handle 22 of the first housing 16 preferably includes a plurality of circumferentially spaced-apart teeth or projections 26 that extend radially inwardly toward a geometric center of the carrier 14. The latch 28 and at least one of the teeth 26 preferably prevents, or at least discourages or hinders, the handle 22 of the first housing 16 from rotating with respect to the base 24 of the first housing 16 in a first rotational direction (e.g., counterclockwise when viewed from above). In particular, if the user 13 attempts to rotate the handle 22 of the first housing 16 in the first rotational direction, at least a portion of the free end 28*a* of the latch 28 preferably engages or contacts one of the teeth 26, thereby at least making it more difficult to rotate the first housing 16 in the first rotational direction.

However, the latch 28 and teeth 26 permit the handle 22 of the first housing 16 to freely rotate with respect to the base 24 of the first housing 16 in a second rotational direction (e.g., clockwise when viewed from above). In particular, as the user 13 rotates the handle 22 of the first housing 16 in the second rotational direction, at least a portion of the free end 28*a* of the latch 28 slides over at least a portion of one or more of the teeth or projections 26 on the interior of the handle 22 of the first housing 16, such as a sloped sidewall thereof, to permit the handle 22 of the first housing 16 to rotate with respect to the base 24 of the first housing 16 in the second rotational direction. In other words, as the handle 22 of the first housing 16 rotates with respect to the base 24 of the first housing 16 in the second rotational direction, at least the free end 28*a* of the latch 28 is intermittently moved at least slightly radially inwardly against the sloped sidewall of at least one or more of the teeth 26.

In use, the adult or other user 13 preferably opens the carrier 14 to the configuration shown in FIG. 2 and locates at least a portion of the handle 12 within at least a portion of the passageway 18 of the carrier 14. The adult 13 then preferably closes the carrier 14 so as to surround the handle 12, as shown in FIGS. 5 and 6. The fastener 23 may then be rotated or moved to an engaged position (see FIG. 1, for example), to generally "lock" the carrier 14 in the closed position. The adult 13 then preferably grasps at least a portion of the handle 22 of the first housing 16 of the carrier 14 to lift and/or move the carrier 14 and the object 10. The handle 22 of the first housing 16 of the carrier 14 preferably freely moves between the positions shown in FIGS. 5 and 6 depending upon the positioning of the adult 13 and the object 10, so as to provide a more comfortable and ergonomically correct orientation of the adult's hand.

It will be appreciated by those skilled in the art that changes could be made to the embodiments described above without departing from the broad inventive concept thereof. For example, the location and/or orientation of the latch 28 and the teeth 26 may be reversed. It is understood, therefore, that this invention is not limited to the particular embodiments disclosed, but it is intended to cover modifications within the spirit and scope of the present invention as defined by the appended claims.

I claim:

1. A carrier removably attachable to at least a portion of a handle of an object for more easily and ergonomically carrying the object, the carrier comprising:

a first housing including a handle and a base, the handle of the first housing being rotatable with respect to the base of the first housing about a first axis;

a second housing pivotally attached to the base of the first housing about a second axis by a hinge, the second axis extending generally perpendicularly to the first axis, wherein the carrier is pivotable between an open configuration in which at least a portion of the base of the first housing is at least partially separated from the second housing to receive at least a portion of a handle of an object therebetween and a closed configuration in which at least a portion of the base of the first housing and the second housing combine to surround the handle of the object therebetween;

a passageway defined by at least a portion of the second housing and at least a portion of the base of the first housing when the carrier is in the closed configuration, the passageway extending completely through the carrier and being configured to receive at least a portion of the handle of the object therein, the passageway extending generally parallel to the second axis;

a fastener positioned on one of the base of the first housing and the second housing generally opposite the hinge permits the base of the first housing to be locked to the second housing in the closed configuration, wherein the handle of the object is between the fastener and the hinge when the handle of the object is in the passageway; and a latch pivotally attached to the base of the first housing, at least a portion of the latch being positioned within the handle of the first housing, the latch engaging at least a portion of an interior of the handle of the first housing to prevent the handle of the first housing from rotating with respect to the base of the first housing in a first rotational direction and to permit the handle of the first housing to rotate with respect to the base of the first housing in a second rotational direction.

2. The carrier according to claim 1, further comprising:

resilient material within at least a portion of the passageway to accommodate a variety of differently sized handles of various objects.

3. The carrier according to claim 1, wherein the handle of the first housing defines an opening configured to receive at least a portion of a user's hand therein.

4. The carrier according to claim 1, wherein the handle of the first housing is rotatable with respect to the base of the first housing over a span of up to 360°.

5. A combination comprising:

an object including a handle; and a carrier removably attachable to at least a portion of the handle of the object, the carrier comprising:

a first housing including a handle and a base, the handle of the first housing being rotatable with respect to the base of the first housing about a first axis;

a second housing pivotally attached to the base of the first housing about a second axis by a hinge, the second axis extending generally perpendicularly to the first axis, wherein the carrier is pivotable between an open configuration in which at least a portion of the base of the first housing is at least partially separated from the second housing to receive at least a portion of the handle of the object therebetween and a closed configuration in which at least a portion of the base of the first housing and the second housing combine to surround the handle of the object therebetween;

a passageway defined by at least a portion of the second housing and at least a portion of the base of the first housing when the carrier is in the closed configuration, the passageway extending completely through the carrier and being configured to receive at least a portion of the handle of the object therein, the passageway extending generally parallel to the second axis;

a fastener positioned on one of the base of the first housing and the second housing generally opposite the hinge permits the base of the first housing to be locked to the second housing in the closed configuration, wherein the handle of the object is between the fastener and the hinge when the handle of the object is in the passageway; and a latch pivotally attached to the base of the first housing, at least a portion of the latch being positioned within the handle of the first housing, the latch engaging at least a portion of an interior of the handle of the first housing to permit the handle of the first housing to rotate with respect to the base of the first housing in a first rotational direction and prevent the handle of the first housing from rotating with respect to the base of the first housing in a second rotational direction.

6. The combination according to claim 5, further comprising:

resilient material within at least a portion of the passageway to accommodate different sized handles of various objects.

7. The combination according to claim 5, wherein the handle of the first housing defines an opening configured to receive at least a portion of a user's hand therein.

8. The combination according to claim 5, wherein the handle of the first housing is rotatable with respect to the base of the first housing over a span of up to 360°.

9. The combination according to claim 5, wherein the handle of the object is at least partially arcuate, is pivotable and defines a passageway with a remainder of the object.

* * * * *